US006582252B1

(12) United States Patent
Lin

(10) Patent No.: US 6,582,252 B1
(45) Date of Patent: Jun. 24, 2003

(54) TERMINATION CONNECTOR ASSEMBLY WITH TIGHT ANGLE FOR SHIELDED CABLE

(75) Inventor: Yuan Chieh Lin, Lake Forest, CA (US)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 10/074,503

(22) Filed: Feb. 11, 2002

(51) Int. Cl.[7] ..... H01R 9/03

(52) U.S. Cl. ..... 439/610; 439/607; 439/357; 439/362; 439/160

(58) Field of Search ..... 439/607–610, 439/357, 378, 362, 372, 160, 347, 76, 465

(56) References Cited

U.S. PATENT DOCUMENTS 4,838,808 A * 6/1989 Fujiura ..... 439/357
5,364,292 A * 11/1994 Bethurum ..... 439/610
5,522,727 A * 6/1996 Saito et al. ..... 439/65
6,083,031 A * 7/2000 Kuo ..... 439/362
6,454,577 B1 * 9/2002 Yi ..... 439/108

* cited by examiner

*Primary Examiner*—Alexander Gilman
(74) *Attorney, Agent, or Firm*—Wei Te Chung

(57) ABSTRACT

An electrical cable termination connector (10) includes a front shell (20), a printed circuit board (PCB) (30), a terminal insert (40), a back shell (50), a spacer (60), latches (72), and a boot (70). The PCB has a first edge (34) and a second edge (36) positioned at right angles to each other. First solder pads (33) along the first edge are electrically connected to corresponding second solder pads (35) along the second edge by traces (37) in the PCB. The PCB attaches to a rear of the front shell and terminals in the terminal insert electrically connect to the first solder pads. Stiff, shielded wires (80) of a cable (90) are fixed in the spacer, and conductors (81) of the wires are attached to the second solder pads. This design enables a 90 degree connection between a cable and a mating connector, without sharp bending of the shielded cable.

13 Claims, 7 Drawing Sheets

TERMINATION CONNECTOR ASSEMBLY WITH TIGHT ANGLE FOR SHIELDED CABLE

BACKGROUND OF THE INVENTION

1. Field of the Invention

The present invention relates to an electrical connector, and particularly to an electrical connector for termination of a cable and having a printed circuit board mounted therein, where the cable termination connector must accomplish a tight bend between the line of the cable and the line of the mating of the connector.

2. Description of the Related Art

Cables used for high speed applications must be very well shielded. One typical kind of cable has a number of wires included inside the cable jacket, each wire having a differential pair of signal conductors and a metallic shield around the pair of signal conductors. The metallic shield tends to make each wire very rigid and difficult to bend. This causes various routing problems when trying to connect a connector terminating the wires in a tight space.

One prior art connector for terminating a high speed cable at a right angle is shown in FIGS. 11–12. The connector 100 has a conductive shell 101. A dielectric insert 109 with a plurality of terminals 102 mounted therein is engaged within a slot (not labeled) through the shell 101. Forward ends (not labeled) of the terminals 102 project forward into the shell 101 for mating with a mating connector (not shown), and rearward ends (not labeled) of the terminals project rearward for soldering to pads (not shown) on a forward end of a printed circuit board (PCB) 103. A plurality of shielded wires 104 from a cable 105 is threaded through a spacer 106. Each wire has a pair of conductors 107 with a wire mesh shield (not labeled) covering the pair of conductors. The conductors 107 are soldered to pads (not labeled) on a rear end of the PCB 103 and the wires 104 in the cable 105 are bent at a 90 degree angle prior to overmolding of a dielectric boot 108 around the cable 105, the spacer 106, the PCB 103, and the shell 101. The tight bend required by this design can be difficult to produce because of the stiffness of the shielded wires 104. More importantly, the wire mesh shield may be damaged during the bending operation or during use in the field, adversely affecting the electrical performance of the cable.

Therefore, a solution to the above problems is desired.

SUMMARY OF THE INVENTION

A first object of the present invention is to provide an electrical cable termination connector which accomplishes a right angle bend while preventing sharp bending of the wires being terminated.

A second object of the present invention is to provide an electrical cable termination connector which accomplishes a right angle bend and which is easily manufactured.

An electrical cable termination connector in accordance with the present invention is designed to terminate stiff, shielded wires in a cable. The termination connector comprises a conductive front shell, a terminal insert comprised of a dielectric body and a plurality of terminals mounted in the dielectric body, a printed circuit board, a dielectric spacer holding wires of the cable being terminated, a conductive back shell, a pair of latches, and a dielectric boot.

The printed circuit board has a first edge and a second edge positioned at right angles to one another. A plurality of first solder pads along the first edge is electrically connected to a plurality of second solder pads along the second edge by traces in the printed circuit board. The insert is engaged with the front shell and the printed circuit board is fitted in a rear of the front shell. Terminals in the insert connect to the first solder pads. The wires are threaded through the spacer, which holds the wires in fixed relation to one another, making the inspection and manufacturing of the cable termination connector easier. Conductors in the wires are connected to the second solder pads. The back shell is assembled to cover the spacer, the printed circuit board, and a rear portion of the front shell. The latches assemble over the back shell and protrude into a mating cavity of the front shell for engaging with a mating connector. The boot is overmolded to cover the back shell, parts of the front shell and latches, the exposed wires, and an end of the cable. The design of the connector allows the cable to be connected to a mating connector oriented 90 degrees to the longitudinal axis of the cable, without the wires of the cable having to bend appreciably. This prevents signal degradation resulting from the wire being damaged by bending.

Other objects, advantages and novel features of the invention will become more apparent from the following detailed description of the present embodiment when taken in conjunction with the accompanying drawings.

DETAILED DESCRIPTION OF THE INVENTION

Figure 1:
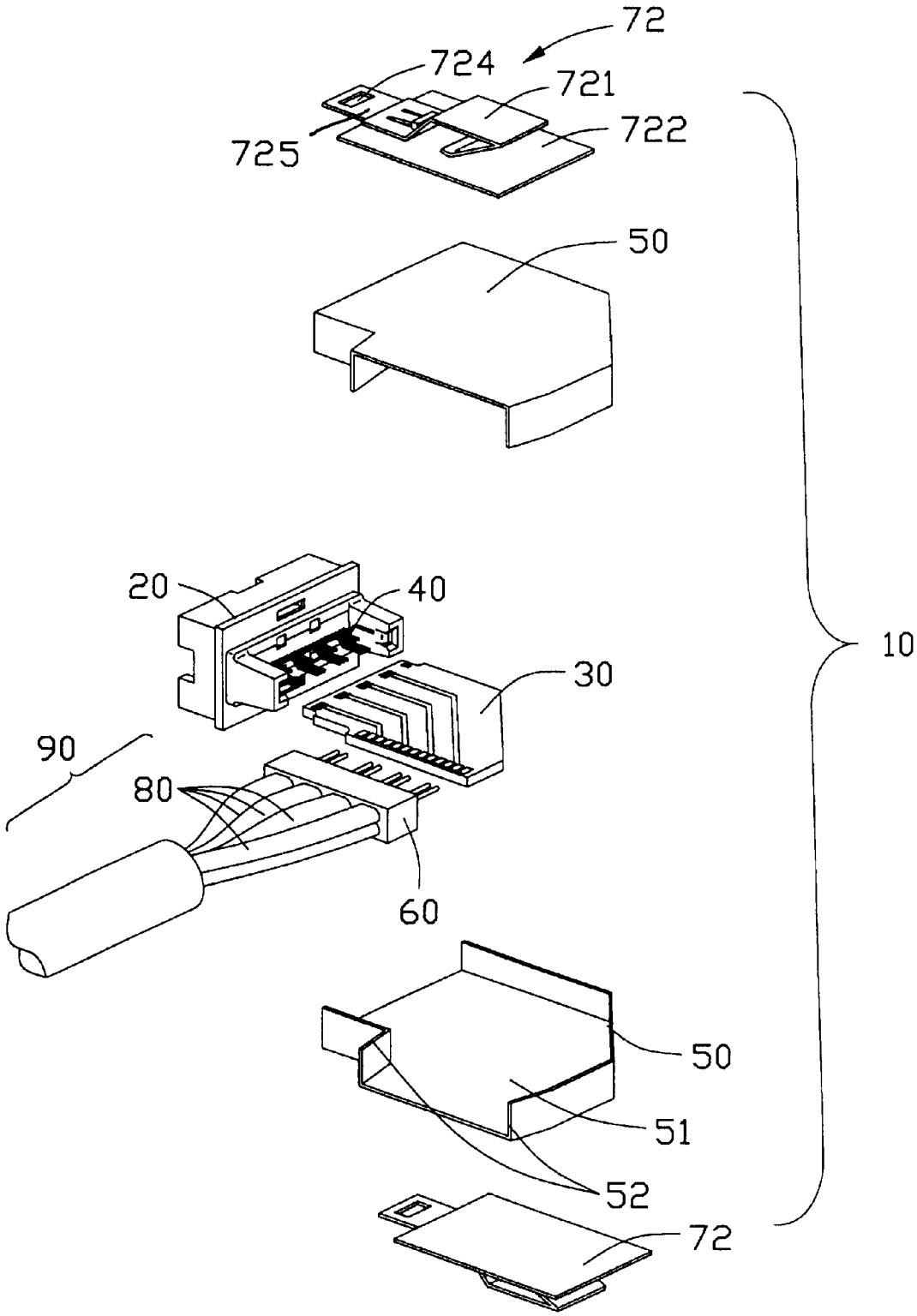
FIG. 1 is a perspective, partially exploded view of an electrical cable termination connector in accordance with the present invention, and a cable, without a boot overmolded to the connector.
Figure 2:
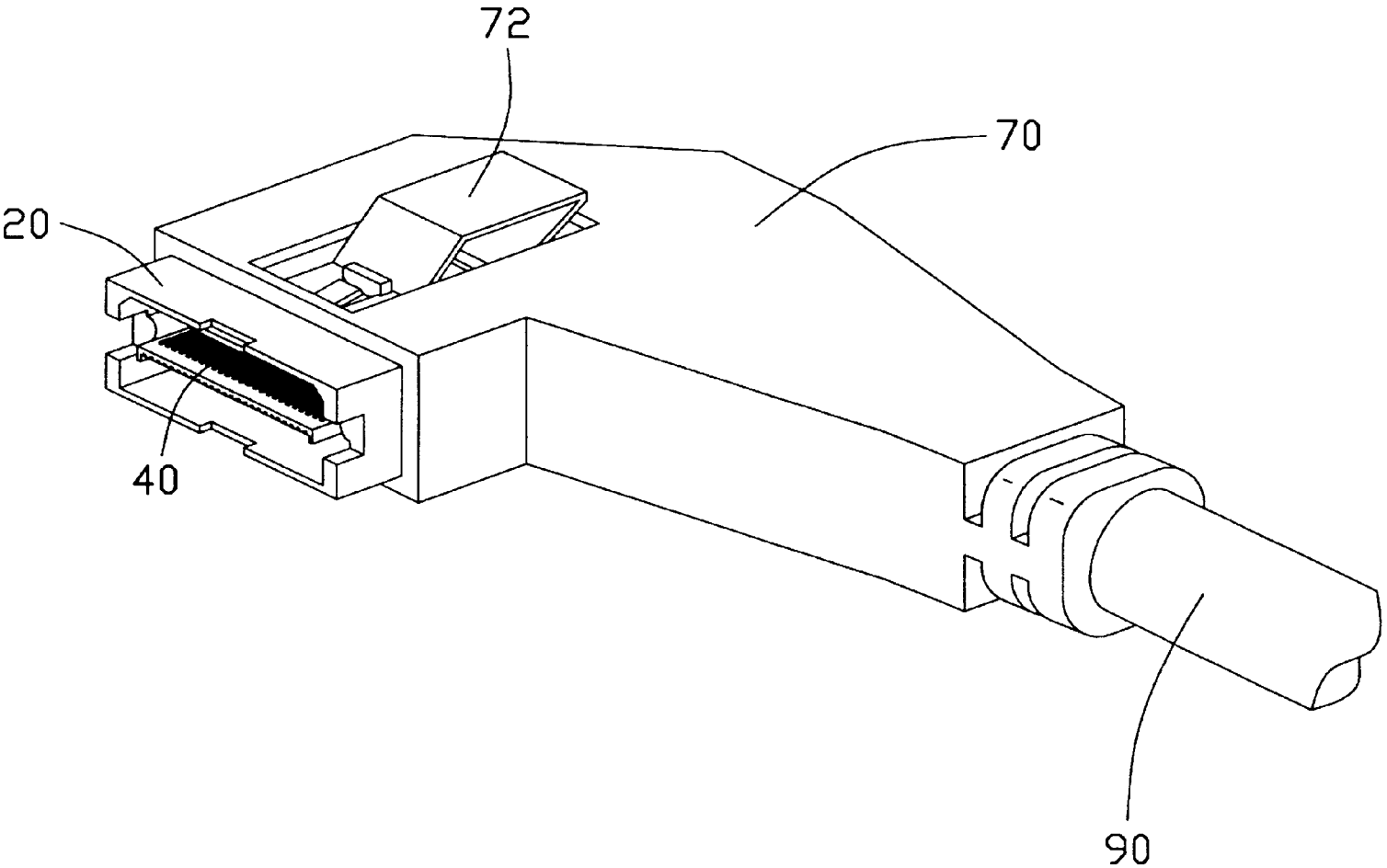
FIG. 2 is an assembled view of the electrical cable termination connector of the present invention wherein the forward portions of the latches are cutaway therefrom to show the terminal insert is located in the cavity.
Figure 3:
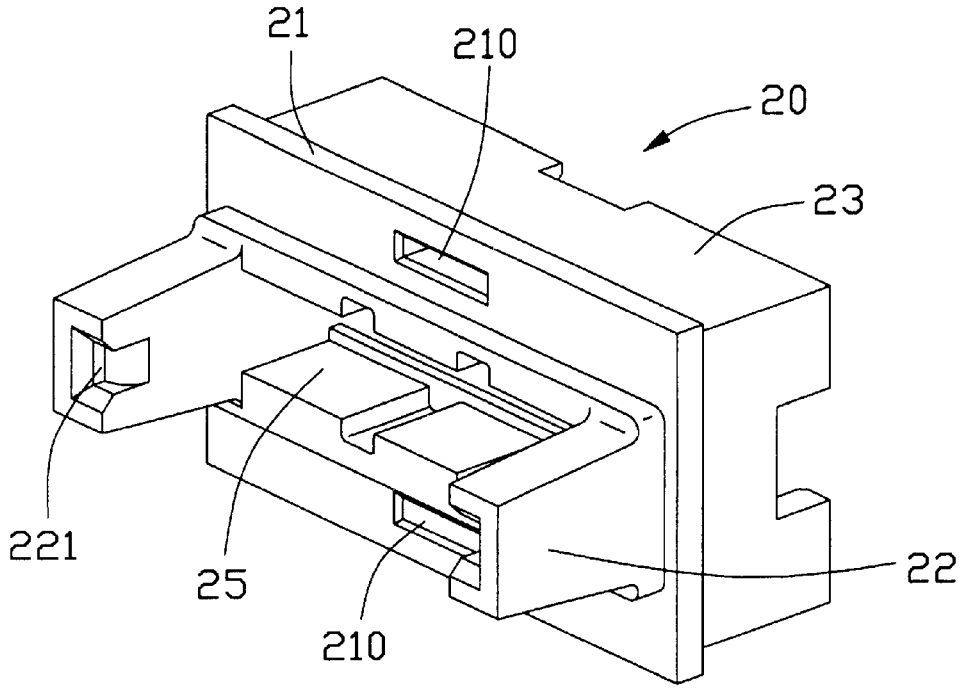
FIG. 3 is a perspective view of a front shell of the electrical connector of FIG. 1.
Figure 4:
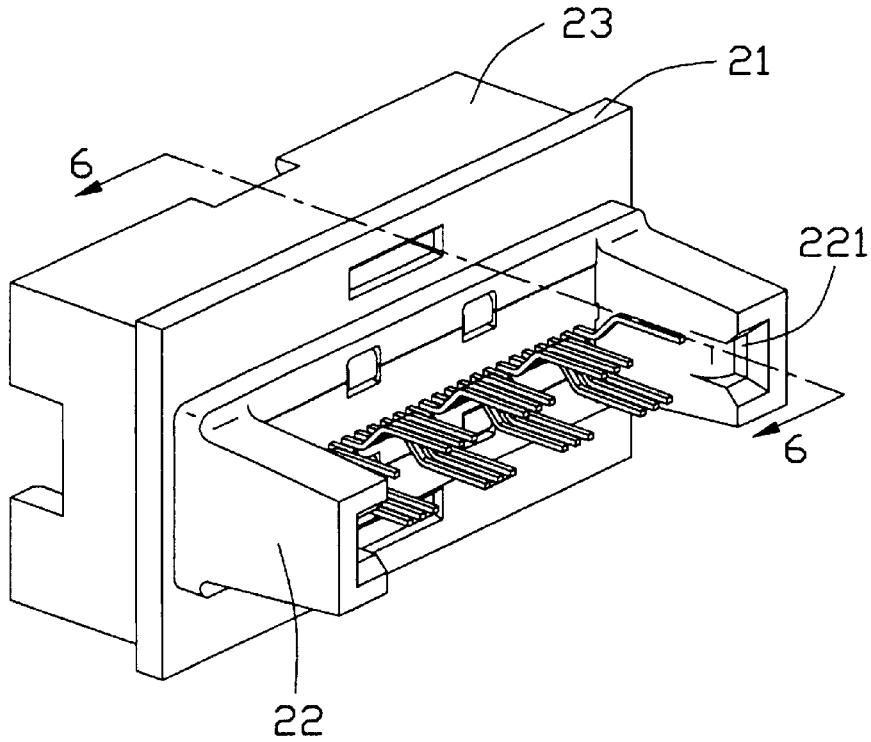
FIG. 4 is a perspective view of a front shell with a terminal insert of the electrical connector of FIG. 1.
Figure 5:
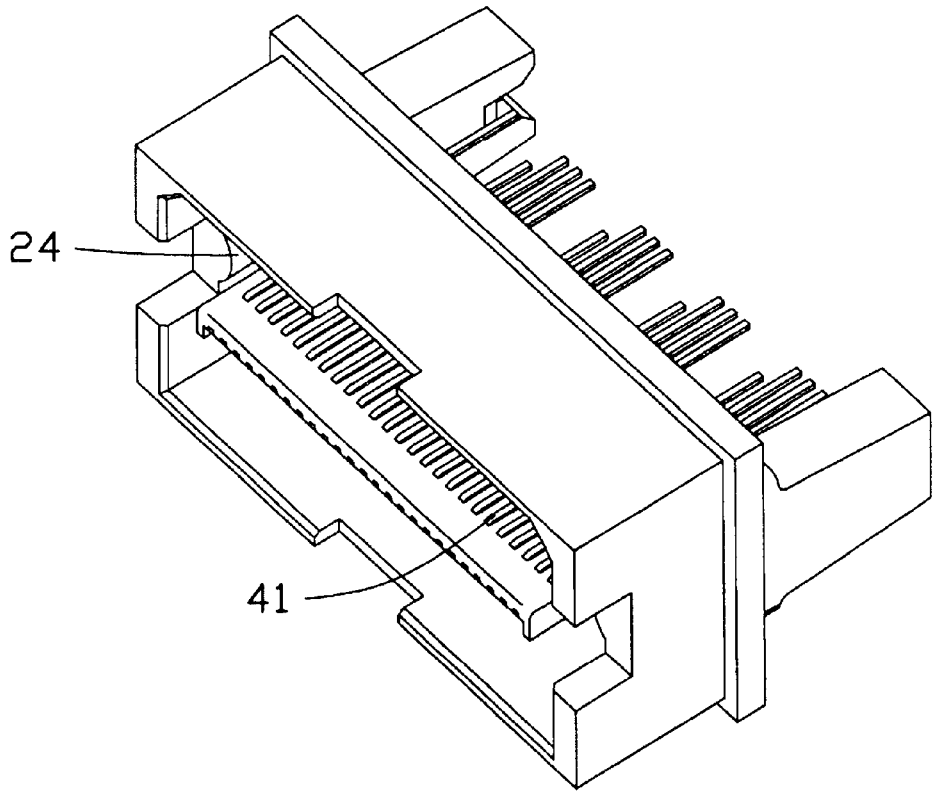
FIG. 5 is a reverse angle view of FIG. 4.
Figure 6:
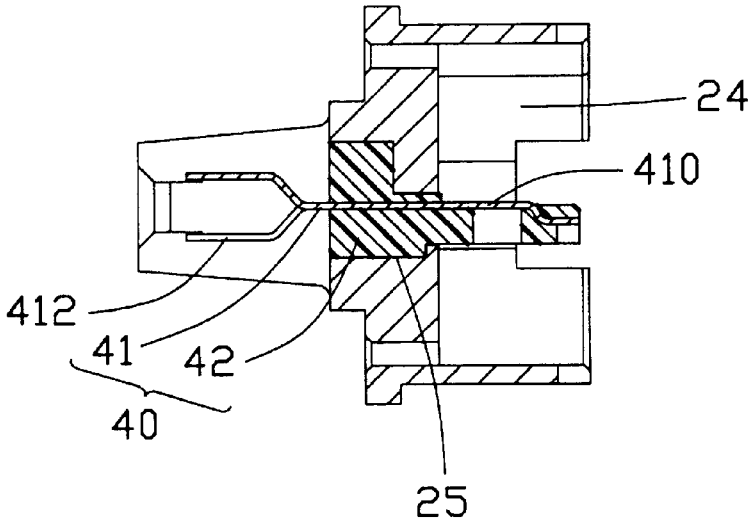
FIG. 6 is a cross-sectional view of the front shell and terminal insert of FIG. 4, taken along the line 6—6.

Referring to FIGS. 1–2, an electrical cable termination connector 10 in accordance with the present invention comprises a conductive front shell 20, a terminal insert 40, a printed circuit board (PCB) 30, a dielectric spacer 60, a conductive back shell 50, a pair of latches 72, and an dielectric boot 70. The electrical cable termination connector 10 is designed to terminate a cable 90 having an outer jacket 91 covering a plurality of shielded wires 80.

Referring also to FIGS. 3–6, the front shell 20 has a rectangular base 21, a four-sided rectangular sleeve 23 projecting forwardly from a front side (not labeled) of the base 21, and a pair of support arms 22 extending rearwardly from a rear side (not labeled) of the base 21. An insert slot 25 is defined through a center of the base 21. A mating cavity 24 is defined within the rectangular sleeve 23 and in front of the base 21, and communicates with the insert slot 25. Each support arm 22 defines a holding slot 221 on an inner surface (not labeled) thereof.

Figure 7:
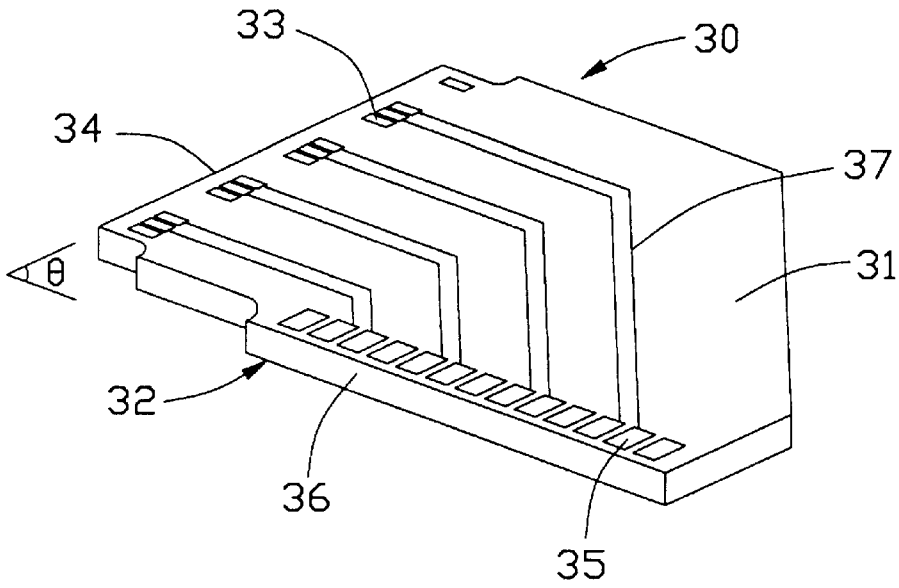
FIG. 7 is a perspective view of the printed circuit board of FIG. 1.

Referring to FIG. 7, the PCB 30 is flat, has an angular shape, and has an upper surface 31 and a lower surface 32. A plurality of first solder pads 33 are positioned on upper and lower surfaces 31,32 along a first edge 34 of the PCB 30, and a plurality of second solder pads 35 are positioned on upper and lower surfaces 31,32 along a second edge 36 of the PCB 30. A plurality of circuit traces 37 connect first solder pads 33 along the first edge 34 with corresponding second solder pads 35 along the second edge 36. The circuit traces 37 can be located on the upper surface 31, on the lower surface 32, or between the upper and lower surfaces 31,32. The first edge 34 is positioned at an angle θ to the second edge 36. In the embodiment shown, the angle is a right angle, but other angles are intended to be included in the invention, to meet various situations.

Referring again to FIGS. 4–6, the terminal insert 40 is manufactured as a separate piece, for assembly through the insert slot 25 of the front shell 20, and comprises a dielectric body 42 and a plurality of terminals 41 held within the body 42. Each terminal 41 (see FIG. 6) has a forward end 410 for engaging with a contact of a mating connector (not shown) and a rearward end 412. The terminals 41 come in two configurations, one (not separately labeled) of which bends upward at its rearward end 412 for connection to the upper surface 31 of the PCB 30 and a second (not separately labeled) of which bends downward for connection to the lower surface 32 of the PCB 30. The plurality of terminals 41 is insert molded into the body 42, which is assembled as one piece into the front shell 20. Alternative embodiments can break the terminal insert 40 into more pieces, or can feature terminals individually inserted through passageways formed in the body 42.

Figure 8:
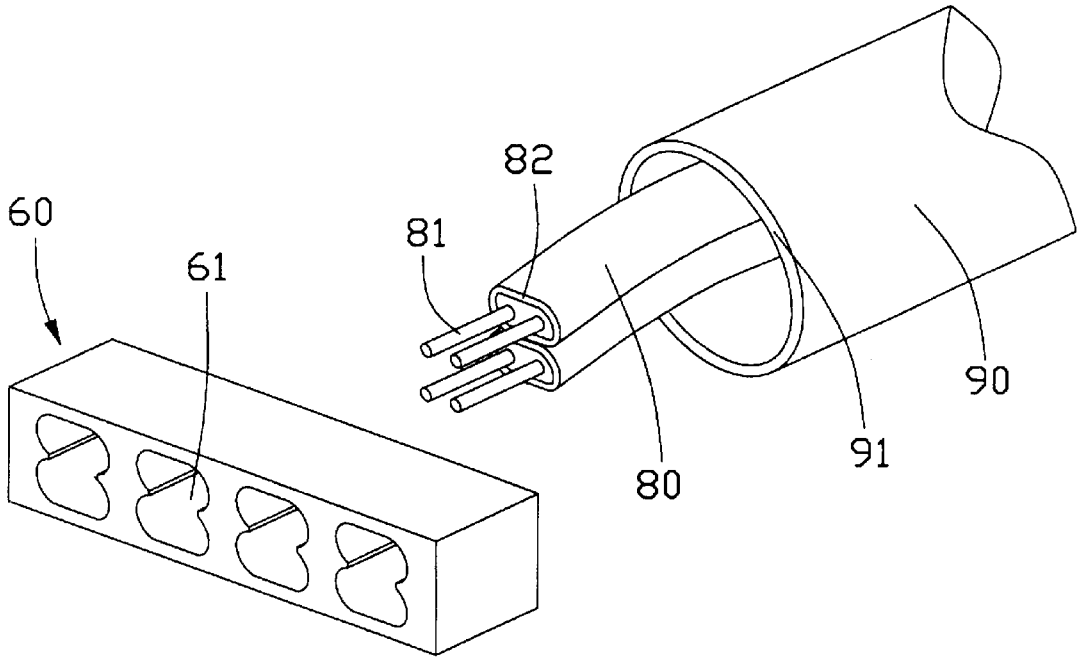
FIG. 8 is a perspective view of the spacer of the electrical connector of FIG. 1, together with a perspective view of a stripped cable used with the electrical connector of FIG. 1.

Referring to FIG. 8, the one-piece spacer 60 is formed in the shape of an elongate block with a plurality of holes 61 defined therethrough. Each hole 61 can have the shape of an outside contour of a wire 80 to be inserted therethrough. (The holes 61 shown in FIG. 8 have a shape to accommodate two wires 80 each, one on top of the other, but other configurations having separate holes 61 for each separate wire 80 are possible.) Each wire 80 shown has a differential pair of signal conductors 81 wrapped in a metallic shield 82. The spacer acts to organize the wires 80 prior to connection of the conductors 81 to the PCB 30, and also acts as an extra strain relief mechanism to protect connections of conductors 81 to second solder pads 35 on the PCB 30.

The conductive back shell 50 (see FIG. 1) is shown in two pieces, each having an angular main surface 51 and a pair of lips 52 extending perpendicular to the main surface 51. The back shell 50 could also be constructed from one piece of sheet metal bended to enclose components therewithin, or in any of a number of variations which establish a metallic shield around a rear portion of the cable termination connector 10.

Figure 9:
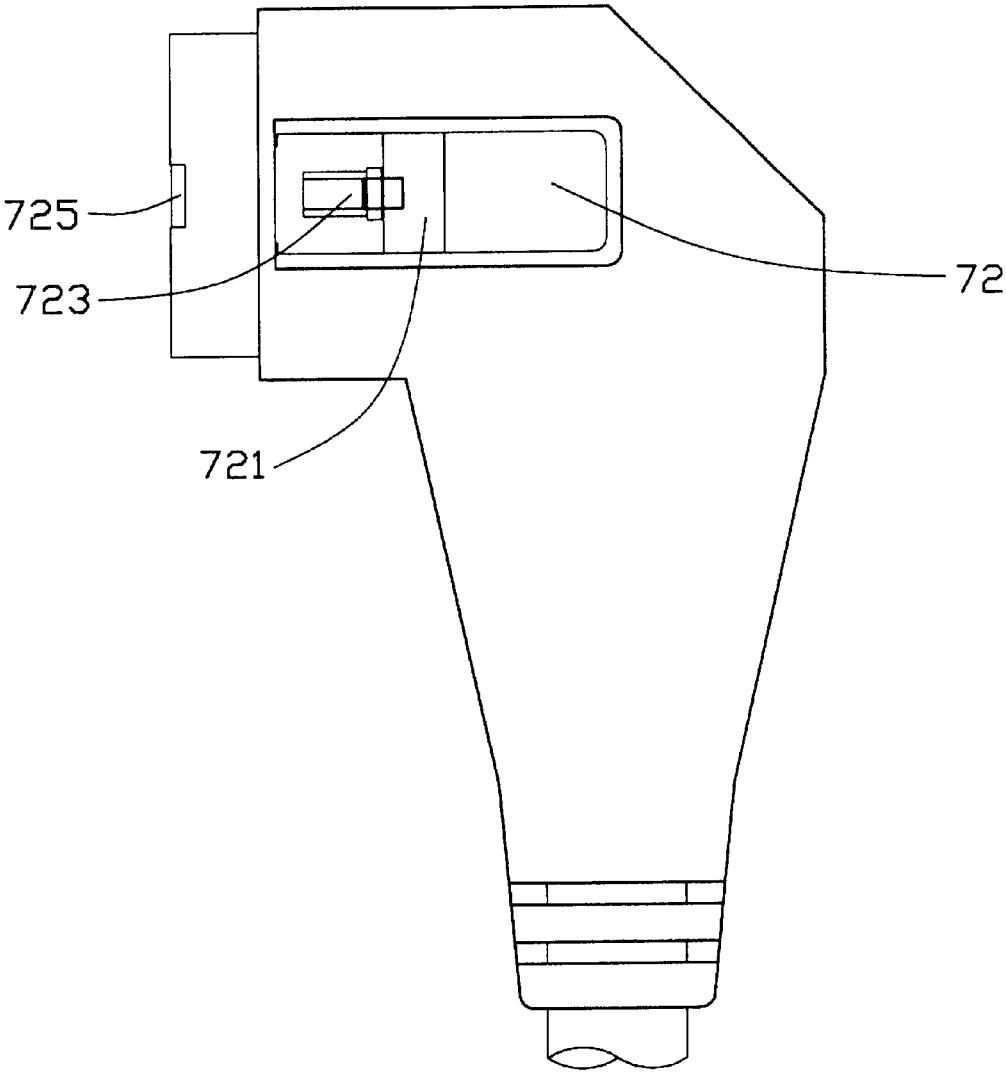
FIG. 9 is a top view of the electrical cable termination connector of FIG. 1 showing one of a pair of latches.
Figure 10:
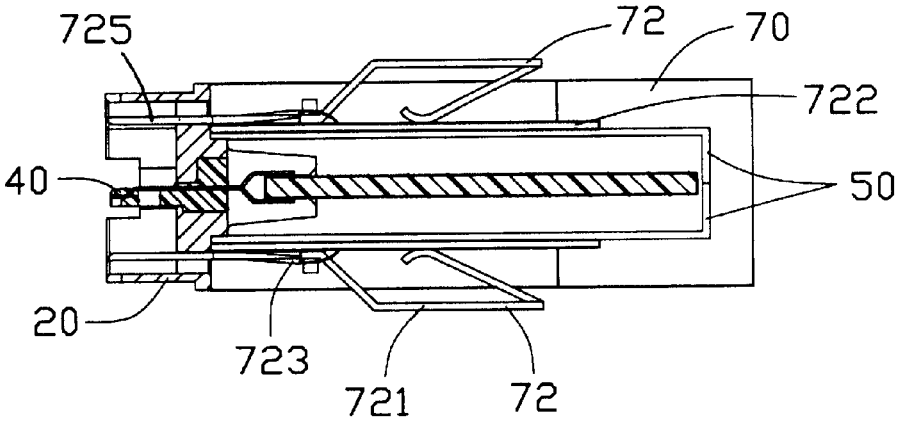
FIG. 10 is a side, partially cut away, schematic view of the electrical cable termination connector of FIG. 9 showing the pair of latches.
Figure 11:
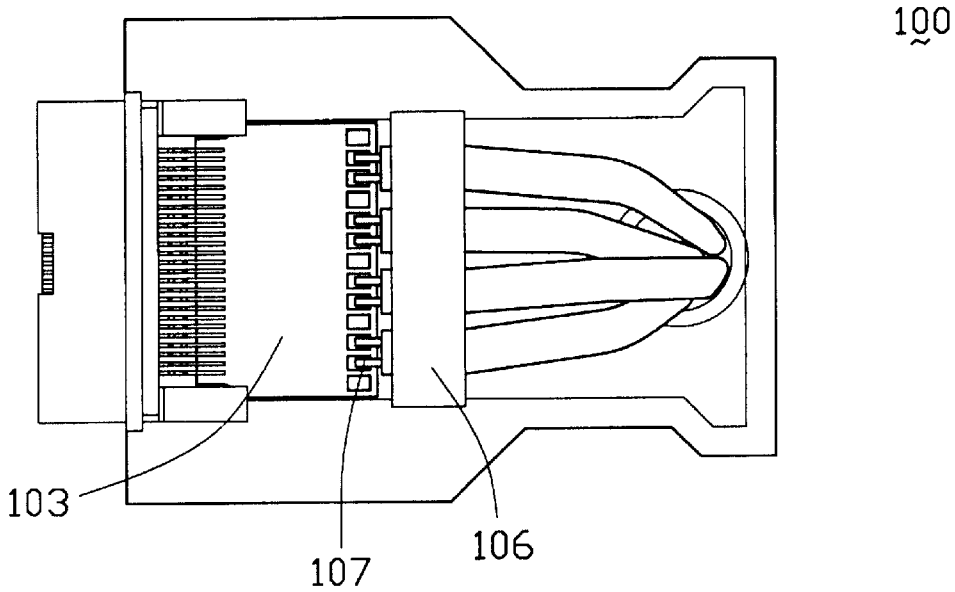
FIG. 11 (PRIOR ART)
FIG. 11 is a top schematic view of a prior art electrical cable termination connector showing the internal arrangement of parts.
Figure 12:
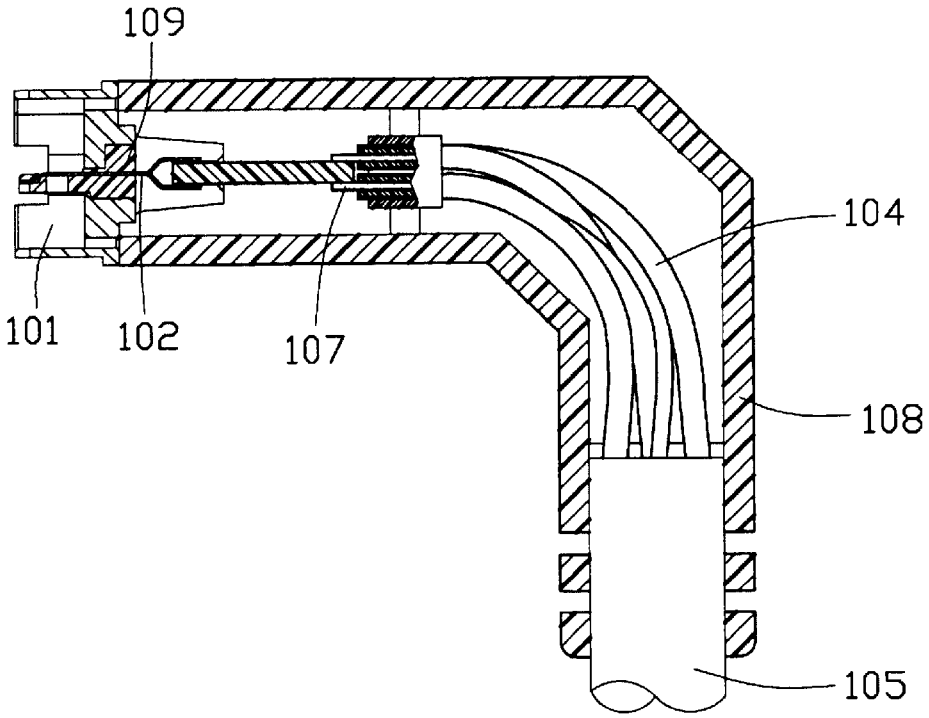
FIG. 12 (PRIOR ART)
FIG. 12 is a side schematic view of the prior art electrical cable termination connector of FIG. 11.

Referring to FIGS. 9–10, the pair of latches 72 each comprises an operation lever 721 attached to a metal base plate 722 by a stud 723. A forward portion 725 of the lever 721 defines a latch aperture 724 (see FIG. 1) for engaging with a complementary member (not shown) of a complementary mating connector (not shown).

In assembly, the terminal insert 40 is pushed through the insert slot 25 of the front shell 20, so that forward ends 410 of the terminals 41 protrude into and are exposed in the mating cavity 24. The PCB 30 is inserted into the holding slots 221 in the support arms 22 until its first edge 34 abuts a forward wall (not labeled) of each slot 221. At this point, the PCB is positioned between terminals 41 bent upwardly and terminals 41 bent downwardly, a rearward end 412 of each terminal 41 abutting a corresponding first solder pad 33. The terminals 41 are soldered to the first solder pads 33. The outer jacket 91 (FIG. 8) is stripped off the end of the cable 90, exposing ends of wires 80, each wire 80 being approximately equal in length. Ends (not labeled) of the wires are inserted through holes 61 of the spacer 60, and the end of each wire 80 can then be stripped to expose a differential pair of conductors 81. The conductors 81 are soldered to corresponding second solder pads 35 on upper and lower surfaces 31,32 of the PCB 30. The back shell 50 is assembled over the spacer 60, the PCB 30, and the support arms 22 of the front shell 20 so that electrical continuity is established between the front shell 20 and the back shell 50. The back shell 50 makes electrical contact with shields 82 of wires 80, assuring electrical continuity from the wire shields 82 to the front shell 20. The latches 72 are emplaced against the back shell 50, one on an upper side (not labeled) and one on a lower side (not labeled) of the cable termination connector 10. The forward portion 725 of each lever 721 is pushed through a corresponding slit 210 (see FIG. 3) to protrude into the mating cavity 24 of the front shell 20. The latches 72 may be conductive and may comprise a portion of the electrical grounding connection from a mating connector through the back shell 50 to the shields 82 of the wires 80. The dielectric boot 70 (FIG. 2) is then overmolded over an end portion of the cable jacket 91, the back shell 50, edges of the base plates 722 of the latches 72, and a rear portion (not labeled) of the front shell 20 which may include the base 21.

The advantage of the present invention over prior art cable end connectors is the end of the cable 90 and wire ends 80 can be kept more or less straight. This eases manufacturing since the difficulty of bending the shielded wires 80 during manufacturing is avoided. This also prevents bending the wires 80 too sharply, which would damage the structure of the wires 80, which would degrade the signal integrity of the high speed transmission wires. The ease of manufacture increases manufacturing yield and lowers manufacturing cost. The circuit traces 37 in the PCB 30 can be designed to have the same length or varying lengths, as desired. In particular, the circuit traces 37 may be routed to have equal lengths or acceptable length differences to control skew. Thus, skew caused by wire length can be controlled, in addition to skew caused by a change in the wire's 80 characteristics due to bending. The circuit traces 37 shown in FIG. 7 are not intended to limit the invention to the design shown.

Other variations are intended to be encompassed by the invention, including but not limited to variations in angle between the first edge 34 and the second edge 36, other variations in shape of the PCB 30 and in the components printed in and mounted on the PCB 30, variations in the spacer 60, including hole size and location, whether the spacer is overmolded over the wires 80 or whether the wires are inserted through holes in a pre-molded spacer, whether a spacer 60 is used at all, and whether the spacer 60 attaches to the second edge 36 of the PCB 30. Variations in cable 90 and wire 80 configurations are also intended to be encompassed by the invention, including varying the number of conductors 81 in each wire 80, the cross-sectional shape of each wire 80, and the number of wires 80 in the cable 90. The boot 70 can alternatively be designed in two pieces which are thermally sealed together, or it can be manufactured by any other means well known in the art.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector for terminating a cable with very stiff wires, and for mating with a complementary connector, comprising:

a front shell for coupling with a mating end of the complementary connector;

a plurality of electrical terminals fixed within the front shell, each having a mating end and a mounting end, the mating end being exposed for mating with complementary contacts of the complementary connector; and a printed circuit board forming a polygon with more than four angles and having a first edge and a second edge, the first and second edges being oriented at a designated, non-zero angle relative to each other, the printed circuit board being electrically connected with the mounting ends of the electrical terminals along its first edge, conductors in the wires of the cable being electrically connected with the printed circuit board along its second edge, and traces within the printed circuit board electrically connecting electrical terminals with corresponding conductors in the wires in the cable.

2. The electrical connector as claimed in claim 1, wherein the angle between the first edge and the second edge is greater than 30 degrees.

3. The electrical connector as claimed in claim 1, wherein the angle between the first edge and the second edge is substantially 90 degrees.

4. The electrical connector as claimed in claim 1, further comprising a dielectric spacer accommodating ends of the wires for holding the wires in designated positions for simplifying connection of the cable to the electrical connector.

5. The electrical connector as claimed in claim 1, further comprising a plurality of first pads along the first edge and a plurality of second pads along the second edge, each first pad being connected with a corresponding second pad via the traces in the printed circuit board, the first pads being for connection with the terminals, and the second pads being for connection with the conductors in the wires.

6. The electrical connector as claimed in claim 5, wherein the traces in the printed circuit board connecting electrical terminals with corresponding conductors of the cable are designed to have substantially a same length.

7. The electrical connector as claimed in claim 1, wherein the front shell is made of a conductive material and the terminals are insert molded into one or more dielectric bodies to make one or more terminal inserts, and the one or more terminal inserts are engagable with the conductive front shell so that the mating ends of the terminals each extend forward into the front shell and the front shell provides protection from electromagnetic interference (EMI) to said mating ends.

8. The electrical connector as claimed in claim 7, further comprising a conductive back shell which is assembled to enclose a portion of the front shell and the PCB, the back shell electrically connecting to the front shell and to the shields of the wires, for providing protection from EMI to the mounting ends of the terminals, to the PCB, and to the bare conductors of the wires attaching to the PCB, the back shell further providing electrical continuity between the front shell, the back shell, and shields of the wires.

9. The electrical connector as claimed in claim 8, further comprising a dielectric boot formed to cover all of the rear shell and an end of the cable.

10. The electrical connector as claimed in claim 9, further comprising a dielectric spacer accommodating ends of the wires for holding the wires in designated positions for simplifying connection of the cable to the electrical connector.

11. The electrical connector as claimed in claim 10, further comprising at least a latch adjacent the back shell and protruding into a mating cavity of the front shell for releasably engaging with a complementary fastening member of a complementary mating connector.

12. A cable connector assembly comprising:

a sleeve defining a lengthwise direction thereof and a cavity therein;

a plurality of terminals disposed in the cavity;

a printed circuit board disposed at a rear portion of the sleeve and extending parallel to said lengthwise direction;

a shielding device enclosing said printed circuit board;

said printed circuit board forming a polygon with more than four angles and defining a first edge mechanically and electrically connected to tails of said terminals, and a second edge mechanically and electrically connected to wires of a cable, both said first edge and said second edge including planar solder pads thereon for soldering with the terminals and the wires of the cable, respectively; wherein said first edge extends along said lengthwise direction, said second edge extends perpendicular to said lengthwise direction, and said cable extends along said lengthwise direction without bending.

13. A cable connector assembly comprising:

a sleeve defining a lengthwise direction thereof and a cavity therein;

a plurality of terminals disposed in the, cavity;

a printed circuit board for connecting said terminals and a cable, said circuit board is disposed at a rear portion of the sleeve and extending parallel to said lengthwise direction and forms a polygon with more than four angles and;

a shielding device enclosing said printed circuit board; and a pair of latches with levers exposed outside of said shielding device while with forward portions extending into the cavity; wherein said forward portions include latching structures for latchable engagement with a complementary connector to prevent said complementary connector from being withdrawn from the sleeve in a first direction perpendicular to said lengthwise direction, and said forward portions are moveable to be disengaged from the complementary connector when levers are manually moved in a second direction perpendicular to both said lengthwise direction and said first direction.

* * * * *